US008073170B2

(12) United States Patent
Kondo et al.

(10) Patent No.: US 8,073,170 B2
(45) Date of Patent: Dec. 6, 2011

(54) HEARING AID ADJUSTER

(75) Inventors: Hiroshi Kondo, Kanagawa (JP); Shigekiyo Fujii, Kanagawa (JP); Yoshiyuki Yoshizumi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1089 days.

(21) Appl. No.: 11/911,120

(22) PCT Filed: Apr. 12, 2006

(86) PCT No.: PCT/JP2006/307706

§ 371 (c)(1),
(2), (4) Date: Oct. 10, 2007

(87) PCT Pub. No.: WO2006/109826

PCT Pub. Date: Oct. 19, 2006

(65) Prior Publication Data

US 2009/0022346 A1 Jan. 22, 2009

(30) Foreign Application Priority Data

Apr. 12, 2005 (JP) ..... 2005-114157

(51) Int. Cl.
*H04R 25/00* (2006.01)

(52) U.S. Cl. ..... 381/314; 381/312

(58) Field of Classification Search ..... 381/314, 381/60, 312

See application file for complete search history.

(56) References Cited

U.S. PATENT DOCUMENTS

| | | | | |
|---|---|---|---|---|
| 4,901,353 | A | 2/1990 | Widin | |
| 6,424,722 | B1 * | 7/2002 | Hagen et al. | 381/314 |
| 7,885,416 | B2 * | 2/2011 | Chalupper et al. | 381/60 |
| 2001/0005420 | A1 | 6/2001 | Takagi et al. | |
| 2003/0179896 | A1 * | 9/2003 | Putvinski | 381/323 |
| 2004/0141626 | A1 * | 7/2004 | Basseas | 381/314 |
| 2005/0036637 | A1 * | 2/2005 | Janssen | 381/315 |

FOREIGN PATENT DOCUMENTS

| | | |
|---|---|---|
| JP | 02-020200 | 1/1990 |
| JP | 6-242794 | 9/1994 |
| JP | 09-054765 | 2/1997 |
| JP | 2001-175637 | 6/2001 |
| JP | 2001-186598 A | 7/2001 |
| JP | 2001-204098 | 7/2001 |
| JP | 2001-238295 A | 8/2001 |

OTHER PUBLICATIONS

PCT/JP2006/307706 Search Report in Japanese.*

PCT/JP2006/307706 Search Report in English.*

International Search Report dated Jul. 28, 2006, PCT/JP2006/307706.

* cited by examiner

*Primary Examiner* — Kenneth Parker
*Assistant Examiner* — Paul Budd
(74) *Attorney, Agent, or Firm* — Panasonic Patent Center; Dhiren Odedra; Kerry Culpepper

(57) ABSTRACT

[PROBLEMS] To easily associate the parameters representing the acoustic characteristic of a hearing aid with the audibility of the hearing aid user, shorten the time for adjusting the hearing aid, and improve the accuracy of the adjustment of the parameter.

[MEANS FOR SOLVING PROBLEMS] By applying a two-dimensional matrix for changing the acoustic parameters of the hearing aid, a person adjusting the hearing aid can easily change the acoustic parameters depending on the audibility of the hearing aid user, the accuracy of the adjustment of the acoustic parameters is improved, and the period of time for adjusting the hearing aid is shortened.

19 Claims, 5 Drawing Sheets

FIG.3

| | | | | |
|---|---|---|---|---|
| X(1,1) | X(2,1) | X(3,1) | ··· | X(n,1) |
| X(1,2) | X(2,2) | X(3,2) | ··· | X(n,2) |
| X(1,3) | X(2,3) | X(3,3) | ··· | X(n,3) |
| ⋮ | ⋮ | ⋮ | | ⋮ |
| X(1,m) | X(2,m) | X(3,m) | ··· | X(n,m) |

FIG.4

Row : 5

Column : 5

| | | | | |
|---|---|---|---|---|
| X(1,1) | X(2,1) | X(3,1) | X(4,1) | X(5,1) |
| X(1,2) | X(2,2) | X(3,2) | X(4,2) | X(5,2) |
| X(1,3) | X(2,3) | X(3,3) | X(4,3) | X5,3) |
| X(1,4) | X(2,4) | X(3,4) | X(4,4) | X(5,4) |
| X(1,5) | X(2,5) | X(3,5) | X(4,5) | X(5,5) |

HEARING AID ADJUSTER

FIELD OF THE INVENTION

The present invention relates to a hearing aid adjuster and a hearing aid adjusting program for calculating and setting the acoustic parameters to determine the acoustic characteristics of the hearing aid.

BACKGROUND OF THE INVENTION

A hearing aid is a device which amplifies acoustic signal received with a microphone and outputs the amplified acoustic signal from a receiver.

A gain as a function of frequency is one of acoustic parameters to determine the acoustic characteristics of the hearing aid, and is defined as the ratio of amplitude of acoustic signal after amplified to amplitude of acoustic signal before amplified.

It is necessary to determine the acoustic characteristics so as to fit to the audibility of a user of the hearing aid.

A conventional hearing aid equips a plurality of filters, each of which is composed of a condenser and a resistor, and the acoustic characteristics of the conventional hearing aid is adjusted by adjusting the characteristic of the filter.

For example, when the hearing aid equips a high-pass filter composed of a condenser and a variable resistor, the attenuation amount of the low-frequency sound can be adjusted by changing a cut-off frequency which varies depending on the resistance value of the variable resister.

Similarly, when the hearing aid equips a low-pass filter, the attenuation amount of the high-frequency component can be adjusted.

As described above, the acoustic characteristic of the conventional hearing aid is determined by adjusting the attenuation amount of the filter.

Some conventional hearing aids equip an output limiter to limit the allowable maximum amplitude of the sound by adjusting the voltage of the power source.

The above-described conventional haring aid is adjusted by a person with a special skill who manually adjusts the variable resistors equipped on the hearing aid with a screw driver.

Recently, a programmable hearing aid providing an electrically erasable programmable memory (hereinafter referred to as EEPROM) and memorizing the set point of the variable register in the EEPROM, and a digital hearing aid, the acoustic characteristic thereof being precisely adjustable by digitally processing the acoustic signal have predominated.

To adjust the modern hearing aid, a hearing aid adjuster is applied.

The hearing aid adjuster determines a plurality of acoustic parameters to realize various acoustic characteristics in the hearing aid, and set the acoustic parameters into the EEPROM equipped on the hearing aid.

When the above-mentioned modern digital hearing aid predominates, the number of the adjustable characteristics, and the number of the acoustic parameters increase, and the number of the combination of the acoustic characteristics and the acoustic parameters becomes extremely big.

The foregoing hearing aid adjuster, however, entails a drawback that it requires long time, and monstrous burden not only of a user of the hearing aid, but also of a person adjusting the hearing aid, when examining all combinations and determining the optimum combination.

For resolving the above drawback, a hearing aid adjusting method applying the Simulated Annealing Method (hereinafter referred to as the SA Method) and/or the Genetic Algorithm Method (hereinafter referred as the GA Method) is already proposed (For example, refer to Patent Publications 1 and 2).

Many hearing aids adjusted with the hearing aid adjuster may require fine adjusting to satisfy the hearing aid user's requirements and to improve the acoustic characteristics.

Further, many hearing aid users may require readjusting of the hearing aid, after using the hearing aid adjusted by the hearing aid adjuster for a certain period.

Therefore, a person who finely adjusts the hearing aid, is required the professional skill to relate the acoustic parameters to the hearing aid user's requirements.

It is difficult, however, for a person with less-experience of adjusting the hearing aid to relate the acoustic parameters to the hearing aid user's requirements, and the person may fail to finely adjust the hearing aid.

Therefore, the hearing aid adjuster which shows changing amount of the acoustic parameters depending on the hearing aid use's requirement or moderately changes the acoustic parameters in accordance with operation of a button, has been applied (For example, refer to Patent Publication 3).

[Patent Publication 1] Unexamined patent publication No. H09-054765

[Patent Publication 2] Unexamined patent publication No. 2001-175637

[Patent Publication 3] Unexamined patent publication No. H02-20200

DETAILED DESCRIPTION OF THE INVENTION

Problems to be Solved by the Invention

Though a person adjusting the hearing aid can partway adjust the acoustic parameters based on the requirement of the hearing aid user, it is difficult for the person to recognize initial values of the acoustic parameters and/or the changing amount from the initial acoustic parameters or the current acoustic parameters.

Especially, in the case of the hearing aid digitally processing the acoustic signal, the recognizing becomes more difficult, because the number of the acoustic parameters to be set increases.

Therefore, the present invention contemplates provision of a hearing aid adjuster making easy for a person adjusting the hearing aid to relate the acoustic parameters to the requirements of the hearing aid user, shortening the adjusting time, and improving adjusting accuracy.

Means for Solving the Problems

According to the first aspect of the present invention, there is provided a hearing aid adjuster for adjusting acoustic characteristics of a hearing aid by setting a plurality of acoustic parameters in said hearing aid, said acoustic parameters determining acoustic characteristics of said hearing aid, comprising: an acoustic parameter calculating and displaying means for calculating a plurality of candidate acoustic parameters within predetermined allowable regions based on data on audibility of a user of said hearing aid or current acoustic parameters stored in said hearing aid, and displaying said plurality of candidate acoustic parameters, and an acoustic parameter setting means for setting a plurality of acoustic parameters selected from said candidate acoustic parameters in said hearing aid.

The hearing aid adjuster thus constructed makes easy for a person adjusting the hearing aid to select the acoustic parameters adequate to satisfy the requirement of the hearing aid user from the displayed candidate acoustic parameters.

Therefore, the person adjusting the hearing aid can relate the acoustic parameters to the acoustic characteristics of the hearing aid without any special skill and can accurately adjust the hearing aid in a short period of time.

According to the second aspect of the present invention, there is provided the hearing aid adjuster in which said acoustic parameter calculating and displaying means comprising: an initial acoustic parameter calculating portion to calculate initial acoustic parameters based on data on audibility of said user of said hearing aid, a first acoustic parameter calculating portion to calculate a plurality of candidate acoustic parameters within predetermined allowable regions based on said initial acoustic parameters calculated by said initial acoustic parameter calculating portion, and a displaying portion to display said candidate acoustic parameters calculated by said first acoustic parameter calculating portion with a matrix form, and said acoustic parameter setting means comprises an identifying signal receiving portion to receive a plurality of identifying signals to identify a plurality of acoustic parameters selected from said candidate acoustic parameters displayed by said displaying portion, and a setting portion to set said acoustic parameters identified by said identifying portion in said hearing aid.

The hearing aid adjuster thus constructed makes easy for a person adjusting the hearing aid to select the acoustic parameters adequate to satisfy the requirement of the hearing aid user from the candidate acoustic parameters displayed with a matrix form.

Therefore, the person adjusting the hearing aid can relate the acoustic parameters to the acoustic characteristics of the hearing aid without any special skill and can accurately adjust the hearing aid in a short period of time.

According to the third aspect of the present invention, there is provided the hearing aid adjuster in which said acoustic parameter calculating and displaying means comprises an acoustic parameter acquiring portion to acquire a plurality of current sound parameters from said hearing aid, a second acoustic parameter calculating portion to calculate a plurality of candidate acoustic parameters within predetermined allowable regions based on said current acoustic parameters acquired by said acoustic parameter acquiring portion, and a displaying portion to display said candidate acoustic parameters calculated by said second acoustic parameter calculating portion with a matrix form, and said acoustic parameter setting means comprises an identifying portion to identify a plurality of acoustic parameters selected from said candidate acoustic parameters displayed by said displaying portion, and a setting portion to set said acoustic parameters identified by said identifying portion in said hearing aid.

The hearing aid adjuster thus constructed makes easy for a person adjusting the hearing aid to select the acoustic parameters adequate to satisfy the requirement of the hearing aid user from the candidate acoustic parameters displayed with a matrix form by acquiring the current acoustic parameters from the hearing aid.

Therefore, the person adjusting the hearing aid can relate the acoustic parameters to the acoustic characteristics of the hearing aid without any special skill and can accurately adjust the hearing aid in a short period of time.

According to the fourth aspect of the present invention, there is provided the hearing aid adjuster in which said first acoustic parameter calculating portion for calculating candidate acoustic parameters calculates said candidate acoustic parameters as elements of a matrix, and said first acoustic parameter calculating portion comprises a first reference acoustic parameter determining part to determine reference acoustic parameters based on data on audibility of a user of said hearing aid, a matrix generating part to generate at least one matrix, a candidate acoustic parameter calculating part to calculate a plurality of candidate acoustic parameters on the basis of said reference acoustic parameters determined by said first reference acoustic parameter determining part, a candidate acoustic parameter assigning part to assign each of said candidate acoustic parameters calculated by said candidate acoustic parameter calculating part to a corresponding element of said matrix generated by said matrix generating part, a matrix element identifying part to identify a plurality of elements selected from said matrix filled with said candidate acoustic parameters in accordance with said identifying signals from said identifying signal receiving portion, and an acoustic parameter outputting part to output said elements identified said matrix element identifying part as acoustic parameters to be set in said hearing aid.

The hearing aid adjuster thus constructed makes easy for a person adjusting the hearing aid to select the acoustic parameters adequate to satisfy the requirement of the hearing aid user from the candidate acoustic parameters displayed with a matrix form.

Therefore, the person adjusting the hearing aid can relate the acoustic parameters to the acoustic characteristics of the hearing aid without any special skill and can accurately adjust the hearing aid in a short period of time.

According to the fifth aspect of the present invention, there is provided the hearing aid adjuster in which said second acoustic parameter calculating portion for calculating said candidate acoustic parameters calculates said candidate acoustic parameters as elements of a matrix, and said second acoustic parameter calculating portion comprises a second reference acoustic parameter determining part to determine reference acoustic parameter based on current acoustic parameters stored in said hearing aid, a matrix generating part to generate at least one matrix, a candidate acoustic parameter calculating part to calculate a plurality of candidate acoustic parameters on the basis of said reference acoustic parameters determined by said second reference acoustic parameter calculating part, the candidate acoustic parameter assigning part to assign each of said candidate acoustic parameters calculated by said candidate acoustic parameter calculating part to a corresponding element of said matrix generated by said matrix generating part, a matrix element identifying part to identify a plurality of elements selected from said matrix filled with said candidate acoustic parameters in accordance with said identifying signals from said identifying signal receiving part, and an acoustic parameter outputting part to output said elements identified said matrix element identifying part as acoustic parameters to be set in said hearing aid.

The hearing aid adjuster thus constructed makes easy for a person adjusting the hearing aid to select the acoustic parameters adequate to satisfy the requirement of the hearing aid user from the candidate acoustic parameters displayed with a matrix form.

Therefore, the person adjusting the hearing aid can relate the acoustic parameters to the acoustic characteristics of the hearing aid without any special skill and can accurately adjust the hearing aid in a short period of time.

According to the sixth aspect of the present invention, there is provided the hearing aid adjuster in which said displaying portion displays said candidate acoustic parameters as elements of two-dimensional matrix.

The hearing aid adjuster thus constructed makes possible to relate one or a plurality of kinds of the acoustic parameters to the acoustic characteristics.

Therefore, the person adjusting the hearing aid can relate the acoustic parameters to the acoustic characteristics of the hearing aid without any special skill and can accurately adjust the hearing aid in a short period of time.

According to the seventh aspect of the present invention, there is provided the hearing aid adjuster in which said displaying portion displays said candidate acoustic parameters as elements of three-dimensional matrix including one of temporally elements or special elements.

The temporally element denotes a period of using time of the hearing aid, and special element denote the user, natural environment such as rain, wind, temperature, humidity, artificial environment such as artificial noise.

The hearing aid adjuster thus constructed makes possible to determine the adequate acoustic parameters in accordance with the user, the using term or the environment.

Therefore, the person adjusting the hearing aid can relate the acoustic parameters to the acoustic characteristics of the hearing aid without any special skill and can accurately adjust the hearing aid in a short period of time.

THE EFFECT OF THE INVENTION

According to the present invention, there is provided a hearing aid adjuster or a hearing aid adjusting program which makes easy to set the acoustic parameters determining the acoustic characteristics of the hearing aid, and shorten a period of time required for adjusting of the hearing aid.

BRIEF EXPLANATIONS OF THE DRAWINGS

FIG. 3 shows a matrix form applied in the embodiment.

FIG. 4 shows an actual example of the matrix applied in the embodiment.

THE EXPLANATION OF THE REFERENCE NUMERALS

Figure 1:
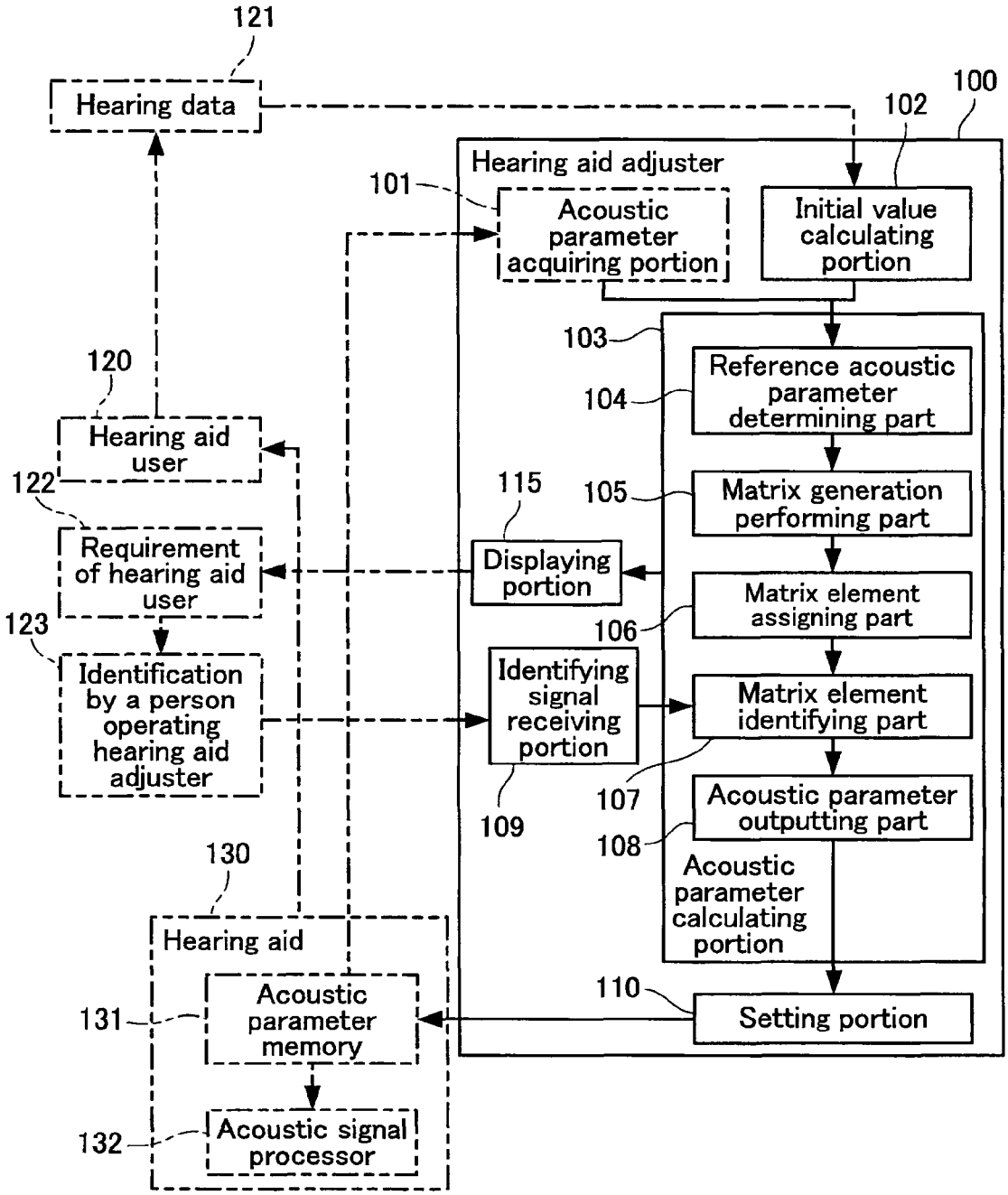
FIG. 1 is a block diagram of a hearing aid adjuster according to the first embodiment of the present invention.

100, 100*a*: Hearing aid adjuster
101: Sound parameter acquiring portion
102: Initial value calculating portion
103: 103*a*: Acoustic parameter calculation portion
104: 104*a*: Reference acoustic parameter determining part
105: Matrix generation performing part
106: Matrix element assigning part
107: Matrix element identifying part
108: Acoustic parameter outputting part
109: Identifying signal receiving portion
110: Setting portion
115: Displaying portion

DESCRIPTION OF THE PREFERRED EMBODIMENT

Referring now to FIGS. 1 to 5 of the accompanying drawings, preferred embodiments of the present invention will be described hereinafter in detail.

FIG. 1 is a block diagram which shows a structure of a first embodiment according to the present invention.

As shown in FIG. 1, a hearing aid adjuster 100 comprises an initial acoustic parameter calculating portion 102 to calculate initial acoustic parameters based on data on audibility of a user of a hearing aid (hereinafter referred to as the audibility data) by using an optimum processing method such as the SA method or the GA method, an acoustic parameter calculating portion (equal to a first acoustic parameter calculating portion) 103 to calculate candidate acoustic parameters as elements of a matrix based on the initial acoustic parameters, a displaying portion 115 to display the candidate acoustic parameters with a matrix form, an identifying signal receiving portion to receive identifying signals to identify acoustic parameters selected from the candidate acoustic parameters calculated by the acoustic parameter calculating portion 103, a setting portion 110 to set the identified acoustic parameters in the hearing aid.

An acoustic parameter calculating and displaying means of the present invention is composed of the first acoustic parameter calculating portion 103 and the displaying portion 115, and an acoustic parameter setting means of the present invention is composed of the identifying signal receiving portion 109 and the setting portion 110.

The acoustic parameter calculating portion 103 comprises a reference acoustic parameter determining part (equal to a first reference acoustic parameter determining part of the present invention) 104 to determine reference acoustic parameters based on the initial acoustic parameters calculated by the initial acoustic parameter calculating portion 102, a matrix generation performing part (equal to a matrix generating part of the present invention) 105 to generate a matrix corresponding to the initial acoustic parameters, a matrix element assigning part 106 to assign each of candidate acoustic parameter calculated on the basis of the reference acoustic parameters determined by the reference acoustic parameter determining part 104 to each element of the matrix generated by the matrix generation performing part 105, a matrix element identifying part 107 to identify acoustic parameters selected from the candidate acoustic parameters in accordance with the identifying signals from the identifying signal receiving portion 109, and an acoustic parameter outputting part 108 to output the identified acoustic parameters identified by the matrix element identifying part 107

The hearing aid adjuster, furthermore, comprises an interface (not shown in FIG. 1) to acquire the audibility data 121 of the hearing aid user 120.

Hereinafter, behavior of the hearing aid according to the first embodiment will be described.

To acquire the hearing data 121 into the hearing aid adjuster 100, it may be applicable to read a file data on the audibility of the hearing aid user, or to input the audibility data manually. Furthermore, various methods such as using a network or a recording media may be applicable for acquiring the audibility data 120 into the hearing aid adjuster 100.

The function of the initial acoustic parameter calculating portion can be executed by a CPU of a personal computer.

In the reference acoustic parameter determining part 140, reference acoustic parameters are determined based on the initial acoustic parameters calculated by the initial acoustic parameter calculating portion 120

The matrix generation performing part 105 generates a two-dimensional n×m matrix with n columns and m rows. Where, n and m are natural numbers The matrix element assigning part 106 assigns the candidate acoustic parameters which exist within a predetermined allowable region, center values thereof are the reference acoustic parameters to elements of the matrix.

That is, the matrix element assigning part 106 calculates the candidate acoustic parameters on the basis of the reference acoustic parameters determined by the reference acoustic parameter determining part 104, and assigns each of the candidate acoustic parameters to a each of the matrix elements.

Each of the candidate acoustic parameters assigned to each of the matrix elements by the matrix element assigning part 106 exists between an upper limit and a lower limit which are pre-determined for each of the acoustic parameters, respectively, or are determined based on the limit of the electronic circuit elements of the hearing aid, or exists within allowable variation width witch is allowed to vary from the reference acoustic parameter by one tuning action.

The candidate acoustic parameters or symbolic codes thereof are displayed as the elements of the matrix, and differences between neighboring elements are constant or vary depending on the differences from the reference acoustic parameters.

Acoustic parameters which satisfy the requirement of the hearing aid user are selected from the candidate acoustic parameters calculated and displayed as the matrix elements by the matrix element assigning part 106.

The identifying signal receiving portion may be composed by a plurality of +/− selectable buttons cooperating with the displaying portion 115, or a combination of a counter button and an up/down switching button.

By operating these buttons, a person who adjusts acoustic characteristics of the hearing aid can easily set up parameters of the hearing aid so that a desirable acoustic characteristic is realized without special skill, and it is also accomplished to reduce the period of time to adjust the hearing aid and to improve the adjusting accuracy.

Alternatively, a speech recognition system which recognizes the vocal orders of a person adjusting the hearing aid, such as "Increase" or "Decrease", can be applied as an identifying signal receiving portion to identify the candidate acoustic parameters.

Next, a hearing aid adjuster according to the second embodiment of the present invention will be explained with reference to FIG. 2.

Figure 2:
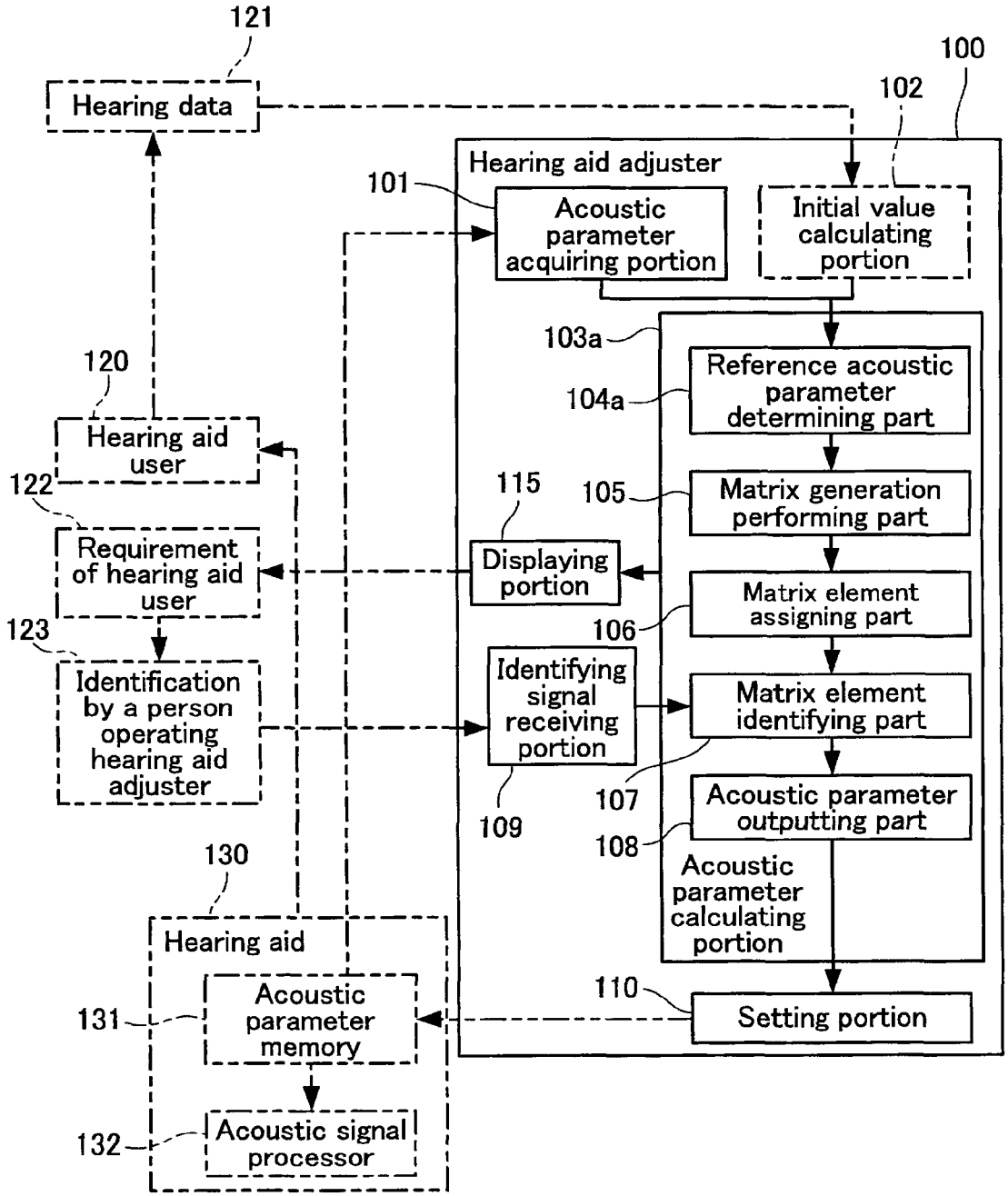
FIG. 2 is a block diagram of a hearing aid adjuster according to the second embodiment of the present invention.

In FIG. 2 showing the block diagram of the second embodiment, the same reference numbers are assigned to the same constituents as the first embodiment shown in FIG. 1, and the explanations of these are omitted.

In the hearing aid of this embodiment 100*a*, the acoustic characteristics already set up in the hearing aid are readjusted on the basis of the current acoustic parameters of the hearing aid 130.

In this embodiment, the hearing aid adjuster 103*a* providing the acoustic parameter calculating portion (equal to the second acoustic parameter calculating portion) equips an acoustic parameter acquiring portion 110 to acquire the current acoustic parameters and other necessary parameters from the hearing aid 130 through the interface unit.

In this embodiment, the second acoustic parameter calculating portion and the displaying portion configure the acoustic parameter calculating and displaying means of the present invention.

The acoustic parameter acquiring portion 101 is connected to the hearing aid providing an acoustic parameter memory 131 to memorize the current acoustic parameters and an acoustic signal processor 132 to process acoustic signal The acoustic parameter acquiring portion 101 of the hearing aid adjuster 100*a* acquires characteristics and current setting values of the acoustic parameters memorized in the acoustic parameter memory 131 of the hearing aid 130.

The characteristics and the setting values of the current acoustic parameters acquired by the acoustic acquiring portion 101 are transferred to the reference acoustic parameter determining part 104 (equal to the second acoustic parameter determining part of the present invention), and are set as the reference acoustic parameters.

Various methods, including a wire transmission and a wireless transmission, can be applied as an acquiring method of the acoustic parameter acquiring portion 101 to acquire the current acoustic parameters memorized in the acoustic parameter memory 131 of the hearing aid.

The matrix generation performing part 105 generates two-dimensional matrixes with n rows and m columns.

Plurality of matrixes may be generated in accordance with characteristics of the acoustic parameters.

That is, the elements of one matrix are set to one of the reference acoustic parameters and a plurality of the candidate acoustic parameters witch exist within a predetermined region of the reference acoustic parameter, or their representative symbols.

The matrix generation performing part 105 generates a plurality of matrixes in accordance with the reference acoustic parameters determined by the reference acoustic parameter determining part 104, but characteristics and sizes of the matrixes may be fixed, predetermined, or determined depending on the reference acoustic parameters determined by the reference acoustic parameter determining part.

At the matrix element assigning part 106, the elements of one matrix are set to the candidate acoustic parameters calculated on the basis of the reference acoustic parameters determined by the reference acoustic parameter determining portion 104.

A concrete example is explained as follows.

In the present embodiment, the matrix generation performing part 105 generates 5×5 matrix as shown in FIG. 4.

The matrix generation performing part 105 can generate a plurality of matrixes with arbitrary numbers of rows and columns, but the matrix generation performing part 105 generates a matrix with the acoustic parameters as a function of frequency, for simplifying the explanation of the present embodiment.

As the elements of the 5×5 matrix generated by the matrix generation performing part 105, the matrix element assigning part 106 assigns the candidate acoustic parameters, high frequency component of which vary in the longitudinal direction, and low frequency component of which vary in the transverse direction.

In an element shown with the form f(a,b), "a" denotes amount of change of low frequency component from one reference acoustic parameter, and "b" denotes amount of change of high frequency component of the reference acoustic parameter.

In the present embodiment, the matrix generation performing part 105 generates a matrix; the elements thereof are a function of frequency, but the present invention is not limited to this embodiment.

The matrix generation performing part 105 can generate a plurality of matrixes having arbitrary number of rows and columns as long as based on the reference acoustic parameters determined by the reference acoustic parameters 104*a*.

The values of the elements may be determined depending not only on frequency, but also other on other variables, for example, an input-output ratio.

Figure 5:
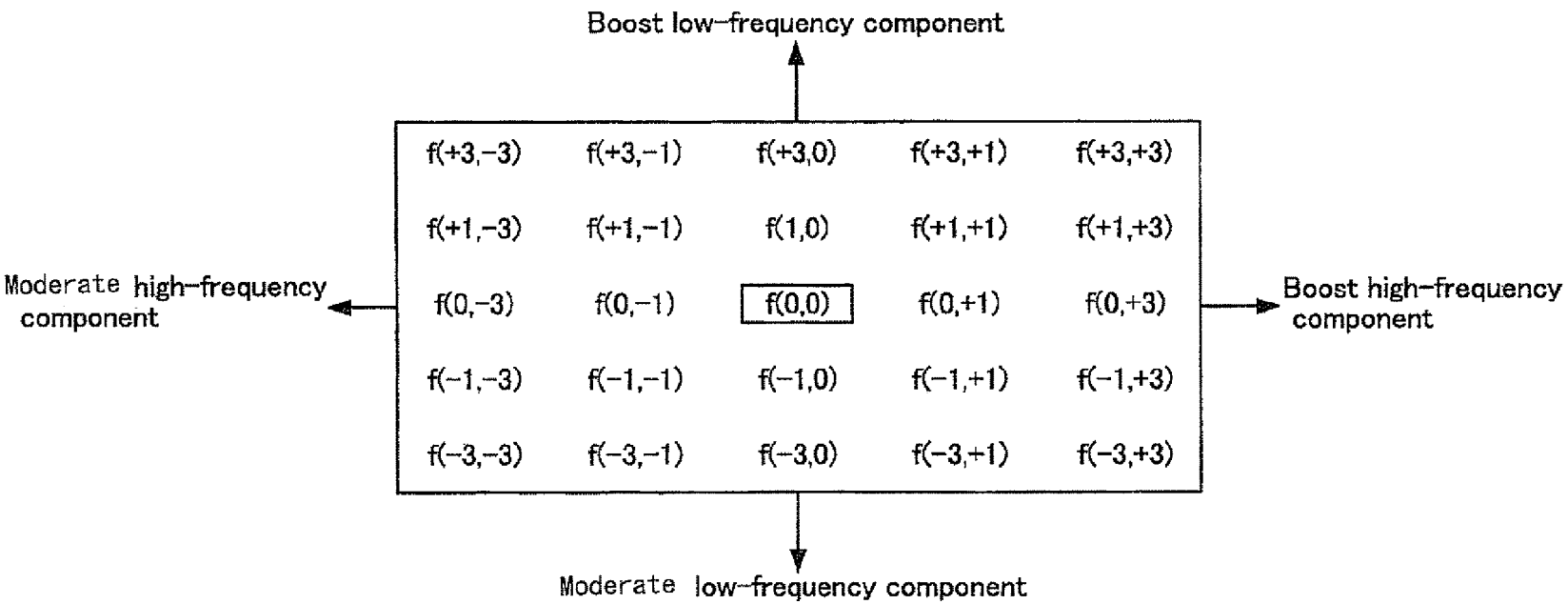
FIG. 5 shows an actual example of the matrix filled with actual set values applied in the embodiment.

FIG. 5 shows a case that a reference acoustic parameter is assigned to the center element X(3,3) of the matrix shown in FIG. 4.

Elements arranged above the center element denote the plus directional candidate acoustic parameters to boost the low frequency component of the acoustic signal, and elements arranged below the center element denote the minus directional candidate acoustic parameters to moderate the low frequency component of the acoustic signal.

Elements arranged on the right hand side of the center element denote the plus directional candidate parameters to boost the high frequency component of the acoustic signal, and elements arranged on the left hand side of the center element denote the minus directional candidate acoustic parameters to moderate the high frequency component of the acoustic signal.

As explained above, when a reference acoustic parameter determined by the reference acoustic parameter determining part 104*a* is assigned to the center element X(3,3) of the matrix generated by the matrix generation performing part 105, other elements of the 5×5 matrix can be easily determined.

If the candidate acoustic parameters which boost the low frequency component of the acoustic signal, that is, the row indexes thereof are plus, for example "+3" are not selectable, the hearing aid adjuster displays the un-selectable candidate acoustic parameters, for example, the elements of top row (X(1,1)-X(5,1)) so as to easily distinguish from other candidate acoustic parameters. Alternatively, the hearing aid adjuster visually, aurally or tactually alerts a person who intends to select the un-selectable candidate acoustic parameters for example, the elements of top row (X(1,1)-X(6,1)) by changing a brightness of the display, generating an alert message or vibrating the hearing aid adjuster.

The candidate acoustic parameters may be determined depending on characteristics of the acoustic parameters, and may be determined so that the candidate acoustic parameters line geometrically or exponentially in accordance with the distance from the reference acoustic parameters to adjust effectively the hearing aid.

A changing amount adjusting means which may be composed with hardware components or software components can be installed around the matrix displayed on the displaying portion to adjust the changing amount of the candidate acoustic parameters in accordance with the distance from the reference acoustic parameters.

As described above, the hearing aid adjuster of the present invention make easy for a person adjusting the hearing aid to identify adequate candidate acoustic parameters so that the hearing aid provides the desired acoustic characteristics without any professional skill of the acoustic parameters.

Further, the hearing aid adjuster of the present invention shortens the time to be required for adjusting the hearing aid and improves the adjusting accuracy of the hearing aid because the acoustic characteristics required by the user of the hearing aid can visually, aurally or tactually be achieved.

Further, the acoustic parameter calculating portion 103, 103*a* may generate a two-dimensional m×n matrix, the elements thereof are set to one or a plurality of the candidate acoustic parameters determined on the basis of the initial acoustic parameters or the current acoustic parameters memorized in the hearing aid and acquired by the acoustic parameter acquiring portion 101 for acquiring the current acoustic parameters.

It is desirable to assign the initial acoustic parameters or the current acoustic parameters to the center element of the two-dimensional m×n matrix, because each of the elements of the two-dimensional m×n matrix is determined as the modified values of the initial acoustic parameters or the current acoustic parameters acquired by the current acoustic parameter acquiring portion 110.

The two dimensional matrix is composed of a plurality of transverse elements determined depending on one kind of acoustic characteristics and a plurality of longitudinal elements determined depending on another kind of acoustic characteristics. Each of the elements of the two-dimensional m×n matrix is filled with one of the candidate acoustic parameters which change the acoustic characteristics of the hearing aid.

It is desirable that n and m are determined as the odd integer, because it is preferable that the number of the elements on one side of the center element is equal to the number of the elements on another side of the center element.

It may be allowable that n and m are determined as the even integer, when the initial acoustic parameters or the acquired current acoustic parameters exist eccentrically in the predetermined region.

Furthermore, it is desirable that the more the elements are apart from the center element, the bigger the values of the elements are set for easy adjusting of the hearing aid.

When one parameter of the candidate acoustic parameters is selected depending on the identifying signals from the identifying signal receiving portion 109 so that the requirement of the hearing aid user 120 is satisfied, the current acoustic parameters memorized in the hearing aid are renewed by the new acoustic parameters outputted from the setting portion 110.

The hearing aid adjuster of the present invention may generate a plurality of two-dimensional matrix, or may provide an acoustic characteristic changing portion to change the acoustic characteristics assigned to the transverse elements or the longitudinal elements.

When the new acoustic parameters determined on the basis of the selected element are inadequate to set in the hearing aid, the hearing aid adjuster makes impossible to select the element by changing the color of the element or distinguishing the element. Therefore, a person adjusting the acoustic parameters of the hearing aid can visually recognize the selectable region of the acoustic parameters.

As describing above, the person adjusting the hearing aid can easily determine the acoustic parameters of the hearing aid so that the requirements of the hearing aid user are satisfied without directly setting the acoustic parameters of the hearing aid.

Next, a hearing aid adjuster according to the third embodiment of the present invention.

As the hearing aid adjuster according to the third embodiment has the same basic structure as the first embodiment and the second embodiment, the same reference numbers are assigned to the same constituents as the first and the second embodiments, the explanations of these constituents are omitted.

A hearing aid adjuster 100*b* according to the third embodiment provides an identifying signal receiving portion 109 to receive identifying signals for identifying the candidate acoustic parameters which realize the acoustic characteristic satisfying the hearing aid user's requirement in the hearing aid.

The hearing aid adjuster may be a dedicated device for adjusting a hearing aid providing a computing part such as a CPU, a data memory and an input/output interface, or may be a computer system executing an initial acoustic parameter calculating program, an acoustic parameter acquiring program and an acoustic parameter calculating program.

In this case, it is effective to display the hearing aid user's requirement received by the identifying signal receiving portion 109 with the quasi-matrix form shown in FIG. 3.

The candidate acoustic parameters displayed on the displaying portion 115 consisting of the display device of a personal computer or a work station may be selected by clicking with a mouse The identified candidate acoustic parameters are set to the acoustic parameter memory 132 through the setting portion 110, and the identified candidate acoustic parameters are memorized in the acoustic parameter memory 131 of the hearing aid.

The hearing aid processes the acoustic signal using the renewed acoustic parameters.

In the above embodiments, the acoustic parameters are determined depending on the gains of low-frequency component and high-frequency component, but the hearing aid user's requirements 122 cover a broad range of matters, such as the volume of sound, clearness, reflecting degree, preference for sharpness, etc.

Therefore, it is effective to generate a plurality of matrixes shown in FIG. 3 and to identify the adequate acoustic parameters so that the various requirements are satisfied.

Many kinds of the acoustic parameters may be determined even when the acoustic parameters are determined as a function of one variable, for example, frequency.

The acoustic parameters may be determined based not only on the low-frequency component, but also on the high frequency component or mid frequency component.

It is desirable to generate a plurality of matrixes corresponding to the kinds of the acoustic parameters.

In the above embodiments, the matrixes are defined as the two-dimensional matrixes, but the matrixes may be defined as more than three-dimensional matrixes with the elements determined based on the time, the user, natural environment such as rain, wind, temperature, humidity, artificial environment such as artificial noise.

As described above, the hearing aid adjuster of the present invention makes easy for a person adjusting a hearing aid to select the sound parameters adequate to realize the desirable acoustic characteristic of the hearing aid and to concisely adjust the acoustic characteristic of the hearing aid. Therefore, the hearing aid adjuster can shorten the period of time required for adjusting the hearing aid and can more accurately adjust the acoustic characteristic of the hearing aid.

INDUSTRIAL APPLICABILITY

The hearing aid adjuster of the present invention is useful, because not only the adjuster makes easy for a person adjusting a hearing aid to adjust the acoustic characteristic of the hearing aid in accordance with the requirement of the user of the hearing aid, but also the adjuster can shorten the time required for adjusting the hearing aid and can more accurately adjust the acoustic characteristic of the hearing aid.

The invention claimed is:

1. A hearing aid adjuster for adjusting acoustic characteristics of a hearing aid by setting a plurality of acoustic parameters in said hearing aid, said acoustic parameters determining acoustic characteristics of said hearing aid, said hearing aid adjuster comprising an acoustic parameter calculating and displaying means configured for calculating a plurality of candidate acoustic parameters within predetermined allowable regions based on data on audibility of a user of said hearing aid or current acoustic parameters stored in said hearing aid, and displaying said plurality of candidate acoustic parameters as a two or more dimensional matrix composed of a plurality of transverse elements determined depending on one kind of acoustic characteristics and a plurality of longitudinal elements determined depending on another kind of acoustic characteristics and arranged in descending order of the acoustic characteristics, and an acoustic parameter setting means configured for setting a plurality of acoustic parameters selected from said candidate acoustic parameters in said hearing aid.

2. The hearing aid adjuster as set forth in claim 1, in which said acoustic parameter calculating and displaying means comprises an initial acoustic parameter calculating portion configured to calculate initial acoustic parameters based on data on audibility of said user of said hearing aid, a first acoustic parameter calculating portion configured to calculate a plurality of candidate acoustic parameters within predetermined allowable regions based on said initial acoustic parameters calculated by said initial acoustic parameter calculating portion, and a displaying portion configured to display said candidate acoustic parameters calculated by said first acoustic parameter calculating portion with a matrix form, and said acoustic parameter setting means comprises an identifying signal receiving portion configured to receive a plurality of identifying signals to identify a plurality of acoustic parameters selected from said candidate acoustic parameters displayed by said displaying portion, and a setting portion configured to set said acoustic parameters identified by said identifying signal receiving portion in said hearing aid.

3. The hearing aid adjuster as set forth in claim 2, in which said first acoustic parameter calculating portion for calculating candidate acoustic parameters calculates said candidate acoustic parameters as elements of a matrix, and said first acoustic parameter calculating portion comprises a first reference acoustic parameter determining part configured to determine reference acoustic parameters based on data on audibility of a user of said hearing aid, a matrix generating part configured to generate at least one matrix, a candidate acoustic parameter calculating part configured to calculate a plurality of candidate acoustic parameters on the basis of said reference acoustic parameters determined by said first reference acoustic parameter determining part, a candidate acoustic parameter assigning part configured to assign each of said candidate acoustic parameters calculated by said candidate acoustic parameter calculating part to a corresponding element of said matrix generated by said matrix generating part, a matrix element identifying part configured to identify a plurality of elements selected from said matrix filled with said candidate acoustic parameters in accordance with said identifying signals from said identifying signal receiving portion, and an acoustic parameter outputting part configured to output said elements identified by said matrix element identifying part as acoustic parameters to be set in said hearing aid.

4. The hearing aid adjuster as set forth in claim 1, in which said acoustic parameter calculating and displaying means comprises an acoustic parameter acquiring portion configured to acquire a plurality of current sound parameters from said hearing aid, a second acoustic parameter calculating portion configured to calculate a plurality of candidate acoustic parameters within predetermined allowable regions based on said current acoustic parameters acquired by said acoustic parameter acquiring portion, and a displaying portion configured to display said candidate acoustic parameters calculated by said second acoustic parameter calculating portion with a matrix form, and said acoustic parameter setting means comprises an identifying portion configured to identify a plurality of acoustic parameters selected from said candidate acoustic parameters displayed by said displaying portion, and a setting portion configured to set said acoustic parameters identified by said identifying portion in said hearing aid.

5. The hearing aid adjuster as set forth in claim 4, in which said second acoustic parameter calculating portion for calculating said candidate acoustic parameters calculates said candidate acoustic parameters as elements of a matrix, and said second acoustic parameter calculating portion comprises a second reference acoustic parameter determining part configured to determine reference acoustic parameter based on current acoustic parameters stored in said hearing aid, a matrix generating part configured to generate at least one matrix, a candidate acoustic parameter calculating part configured to calculate a plurality of candidate acoustic parameters on the basis of said reference acoustic parameters determined by said second reference acoustic parameter calculating part, a candidate acoustic parameter assigning part configured to assign each of said candidate acoustic parameters calculated by said candidate acoustic parameter calculating part to a corresponding element of said matrix generated by said matrix generating part, a matrix element identifying part configured to identify a plurality of elements selected from said matrix filled with said candidate acoustic parameters in accordance with said identifying signals from said identifying signal receiving part, and an acoustic parameter outputting part configured to output said elements identified said matrix element identifying part as acoustic parameters to be set in said hearing aid.

6. The hearing aid adjuster as set forth in claim 2 or claim 4, in which said displaying portion displays said candidate acoustic parameters as elements of three-dimensional matrix including one of temporally elements or special elements.

7. The hearing aid adjuster as set forth in claim 1, wherein the acoustic parameter calculating and displaying means is configured to assign the initial acoustic parameters or the current acoustic parameters to a center element of the two-dimensional matrix.

8. A computer readable medium storing a hearing aid adjusting program for adjusting acoustic characteristics of a hearing aid by setting a plurality of acoustic parameters in said hearing aid, said acoustic parameters determining acoustic characteristics of said hearing aid, said hearing aid adjusting program comprising:

an acoustic parameter calculating and displaying step for calculating a plurality of candidate acoustic parameters within predetermined allowable regions based on data on audibility of a user of said hearing aid or current sound parameters stored in said hearing aid, and displaying said plurality of candidate acoustic parameters as a two or more dimensional matrix composed of a plurality of transverse elements determined depending on one kind of acoustic characteristics and a plurality of longitudinal elements determined depending on another kind of acoustic characteristics and arranged in descending order of the acoustic characteristics, and an acoustic parameter setting step for setting a plurality of acoustic parameters selected from said candidate acoustic parameters in said hearing aid.

9. The hearing aid adjusting program as set forth in claim 8, in which said acoustic parameter calculating and displaying step comprises an initial acoustic parameter calculating step to calculate initial acoustic parameters based on data on audibility of said user of said hearing aid, a first acoustic parameter calculating step to calculate a plurality of candidate acoustic parameters within predetermined allowable regions based on said initial acoustic parameters calculated at said initial acoustic parameter calculating step, and a displaying step to display said candidate acoustic parameters calculated at said first acoustic parameter calculating step with a matrix form, and said acoustic parameter setting step comprises an identifying signal receiving step to receive a plurality of identifying signals to identify a plurality of acoustic parameters selected from said candidate acoustic parameters displayed at said displaying step, and a setting step to set said acoustic parameters identified by said identifying step in said hearing aid.

10. The hearing aid adjusting program as set forth in claim 8, in which said acoustic parameter calculating and displaying step comprises an acoustic parameter acquiring step to acquire a plurality of current sound parameters from said hearing aid, a second acoustic parameter calculating step to calculate a plurality of candidate acoustic parameters within predetermined allowable regions based on said current acoustic parameters acquired at said acoustic parameter acquiring step, and a displaying step to display said candidate acoustic parameters calculated at said second acoustic parameter calculating step with a matrix form, and said acoustic parameter setting step comprises an identifying step to identify a plurality of acoustic parameters selected from said candidate acoustic parameters displayed at said displaying step, and a setting step to set said acoustic parameters identified by said identifying step in said hearing aid.

11. A hearing aid adjuster for adjusting acoustic characteristics of a hearing aid, said hearing aid adjuster comprising:

an acoustic parameter calculating and displaying section configured to calculate a plurality of candidate acoustic parameters within predetermined allowable regions based on data on audibility of a user of said hearing aid or current acoustic parameters stored in said hearing aid, and display said plurality of candidate acoustic parameters as a two or more dimensional matrix composed of a plurality of transverse elements determined depending on one kind of acoustic characteristics and a plurality of longitudinal elements determined depending on another kind of acoustic characteristics and arranged in descending order of the acoustic characteristics; and an acoustic parameter setting section configured to set a plurality of acoustic parameters selected from said candidate acoustic parameters in said hearing aid.

12. The hearing aid adjuster as set forth in claim 11, wherein said acoustic parameter calculating and displaying section comprises:

an initial acoustic parameter calculating portion configured to calculate initial acoustic parameters based on the data on audibility of said user of said hearing aid;

a first acoustic parameter calculating portion configured to calculate a plurality of candidate acoustic parameters within the predetermined allowable regions based on said initial acoustic parameters calculated by said initial acoustic parameter calculating portion; and a displaying portion configured to display said candidate acoustic parameters calculated by said first acoustic parameter calculating portion within the two or more dimensional matrix, wherein said acoustic parameter setting section comprises:

an identifying signal receiving portion configured to receive a plurality of identifying signals to identify a plurality of acoustic parameters selected from said candidate acoustic parameters displayed by said displaying portion, and a setting portion configured to set said acoustic parameters identified by said identifying signal receiving portion in said hearing aid.

13. The hearing aid adjuster as set forth in claim 12, wherein:

said first acoustic parameter calculating portion for calculating candidate acoustic parameters calculates said candidate acoustic parameters as elements of the matrix, and said first acoustic parameter calculating portion comprises:

a first reference acoustic parameter determining part configured to determine reference acoustic parameters based on data on audibility of a user of said hearing aid, a matrix generating part configured to generate at least one matrix, a candidate acoustic parameter calculating part to calculate a plurality of candidate acoustic parameters on the basis of said reference acoustic parameters determined by said first reference acoustic parameter determining part, a candidate acoustic parameter assigning part configured to assign each of said candidate acoustic parameters calculated by said candidate acoustic parameter calculating part to a corresponding element of said matrix generated by said matrix generating part, a matrix element identifying part configured to identify a plurality of elements selected from said matrix filled with said candidate acoustic parameters in accordance with said identifying signals from said identifying signal receiving portion, and an acoustic parameter outputting part configured to output said elements identified by said matrix element identifying part as acoustic parameters to be set in said hearing aid.

14. The hearing aid adjuster as set forth in claim 12, in which said displaying portion is configured to display said candidate acoustic parameters as elements of three-dimensional matrix including one of temporally elements or special elements.

15. The a hearing aid adjuster as set forth in claim 11, wherein said acoustic parameter calculating and displaying section comprises:

an acoustic parameter acquiring portion configured to acquire a plurality of current sound parameters from said hearing aid, a second acoustic parameter calculating portion configured to calculate a plurality of candidate acoustic parameters within the predetermined allowable regions based on said current acoustic parameters acquired by said acoustic parameter acquiring portion, and a displaying portion configured to display said candidate acoustic parameters calculated by said second acoustic parameter calculating portion within the two or more dimensional matrix, said acoustic parameter setting section comprises:

an identifying portion configured to identify a plurality of acoustic parameters selected from said candidate acoustic parameters displayed by said displaying portion, and a setting portion configured to set said acoustic parameters identified by said identifying portion in said hearing aid.

16. The hearing aid adjuster as set forth in claim 15, wherein said second acoustic parameter calculating portion for calculating said candidate acoustic parameters calculates said candidate acoustic parameters as elements of a matrix, and said second acoustic parameter calculating portion comprises:

a second reference acoustic parameter determining part to determine reference acoustic parameter based on current acoustic parameters stored in said hearing aid, a matrix generating part to generate at least one matrix, a candidate acoustic parameter calculating part to calculate a plurality of candidate acoustic parameters on the basis of said reference acoustic parameters determined by said second reference acoustic parameter calculating part, a candidate acoustic parameter assigning part to assign each of said candidate acoustic parameters calculated by said candidate acoustic parameter calculating part to a corresponding element of said matrix generated by said matrix generating part, a matrix element identifying part to identify a plurality of elements selected from said matrix filled with said candidate acoustic parameters in accordance with said identifying signals from said identifying signal receiving part, and an acoustic parameter outputting part to output said elements identified by said matrix element identifying part as acoustic parameters to be set in said hearing aid.

17. The hearing aid adjuster as set forth in claim 15, in which said displaying portion is configured to display said candidate acoustic parameters as elements of three-dimensional matrix including one of temporally elements or special elements.

18. The hearing aid adjuster as set forth in claim 11 wherein the acoustic parameter calculating and displaying section is configured to assign the initial acoustic parameters or the current acoustic parameters to a center element of the two-dimensional matrix.

19. A hearing aid adjuster for adjusting acoustic characteristics of a hearing aid by setting a plurality of acoustic parameters in said hearing aid, said acoustic parameters determining acoustic characteristics of said hearing aid, said hearing aid adjuster comprising:

a display portion;

a processor; and a memory for storing instructions for configuring the processor, wherein the processor is configured to:

calculate a plurality of candidate acoustic parameters within predetermined allowable regions based on data on audibility of a user of said hearing aid or current sound parameters stored in said hearing aid;

display said plurality of candidate acoustic parameters in the display portion as a two or more dimensional matrix composed of a plurality of transverse elements determined depending on one kind of acoustic characteristics and a plurality of longitudinal elements determined depending on another kind of acoustic characteristics and arranged in descending order of the acoustic characteristics; and set a plurality of acoustic parameters selected from said candidate acoustic parameters in said hearing aid.

* * * * *

UNITED STATES PATENT AND TRADEMARK OFFICE

CERTIFICATE OF CORRECTION

PATENT NO. : 8,073,170 B2
APPLICATION NO. : 11/911120
DATED : December 6, 2011
INVENTOR(S) : Kondo et al.

It is certified that error appears in the above-identified patent and that said Letters Patent is hereby corrected as shown below:

Column 15, line 65 (Claim 15): "The a hearing aid adjuster..." should read --The hearing aid adjuster...--

Signed and Sealed this
Seventh Day of February, 2012

David J. Kappos

David J. Kappos
*Director of the United States Patent and Trademark Office*